US007826769B2

(12) United States Patent
Yamaguchi

(10) Patent No.: US 7,826,769 B2
(45) Date of Patent: Nov. 2, 2010

(54) IMAGE FORMING DEVICE

(75) Inventor: Takuya Yamaguchi, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 47 days.

(21) Appl. No.: 12/392,125

(22) Filed: Feb. 25, 2009

(65) Prior Publication Data

US 2009/0214258 A1 Aug. 27, 2009

(30) Foreign Application Priority Data

Feb. 26, 2008 (JP) ..... 2008-044632

(51) Int. Cl.
*G03G 15/00* (2006.01)

(52) U.S. Cl. ..... 399/125

(58) Field of Classification Search ..... 399/107, 399/110, 111, 119, 121, 125
See application file for complete search history.

(56) References Cited

U.S. PATENT DOCUMENTS

| | | | | |
|---|---|---|---|---|
| 7,133,626 | B2 * | 11/2006 | Kaiga et al. | 399/110 |
| 7,680,431 | B2 * | 3/2010 | Ikebata | 399/107 |
| 2002/0012021 | A1 | 1/2002 | Umeyama et al. | |
| 2007/0047028 | A1 | 3/2007 | Hashimoto et al. | |

FOREIGN PATENT DOCUMENTS

| | | |
|---|---|---|
| JP | 03-063153 | 3/1991 |
| JP | 04-053988 | 5/1992 |
| JP | 05-323686 | 12/1993 |
| JP | 07-333934 | 12/1995 |
| JP | 2000-181164 | 6/2000 |
| JP | 2001-277515 | 10/2001 |
| JP | 2001-281771 | 10/2001 |
| JP | 2002-342505 | 11/2002 |
| JP | 2007-065066 | 3/2007 |

OTHER PUBLICATIONS

Notification of Reasons of Rejection issued in the Japanese Application No. 2008-044632 mailed Apr. 20, 2010.

* cited by examiner

*Primary Examiner*—Hoan Tran
(74) *Attorney, Agent, or Firm*—Banner & Witcoff, Ltd

(57) ABSTRACT

An image forming device includes a swing body attached to a main body swingably around a first axis between a first state away from the main body and a second state close to the main body, an arm having a first end attached to one of the main body and the swing body swingably around a second axis parallel to the first axis and a second end joined with a second one of the two bodies slidably to be close to or away from the first axis, and a pressing member provided to the second one of the two bodies to press the arm toward the second axis in the second state. The second end includes a contact surface to contact the pressing member that is parallel to the second axis and slanted relative to a virtual plane perpendicular to an axial line of the arm.

12 Claims, 12 Drawing Sheets

IMAGE FORMING DEVICE

CROSS-REFERENCE TO RELATED APPLICATION

This application claims priority under 35 U.S.C. §119 from Japanese Patent Application No. 2008-044632 filed on Feb. 26, 2008. The entire subject matter of the application is incorporated herein by reference.

BACKGROUND

1. Technical Field

The following description relates to one or more image forming devices with a swing body such as a top cover swingably attached to a main body.

2. Related Art

For example, Japanese Patent Provisional Publication No. 2001-281771 (hereinafter, simply referred to as '771 Publication) discloses a device that is provided with a swing body such as a platen cover swingably attached to a main body including an image forming unit and configured to prevent the swing body from swinging excessively relative to the main body by using a wire.

SUMMARY

However, the device disclosed in '771 Publication is only adopted to keep the swing body from swinging excessively with respect to the main body by using the wire. Hence, with the device disclosed in '771 Publication, there is a problem that when the swing body is shut to be close to the main body, the shutting operation might be done at such a high speed that the swing body collides against the main body.

Thus, the swing body and/or the main body might be damaged when the swing body is shut at such a high speed as to collide against the main body.

Aspects of the present invention are advantageous to provide one or more improved image forming devices that make it possible to, when a swing body is shut to be close to a main body of the image forming device, prevent the swing body from colliding against the main body at a high speed.

According to aspects of the present invention, an image forming device is provided, which includes a main body, a swing body attached to the main body swingably around a first axis as a predetermined swing central axis thereof between a first state where the swing body is away from the main body and a second state where the swing body is close to the main body, an arm having a first end and a second end in a longitudinal direction thereof, the first end of the arm being attached to a first one of the main body and the swing body, swingably around a second axis parallel to the first axis of the swing body as a predetermined swing central axis of the arm, the second end of the arm being joined with a second one of the main body and the swing body, slidably to be close to or away from the first axis of the swing body, and a pressing member provided to the second one of the main body and the swing body, the pressing member being configured to establish contact with the second end of the arm and to press the arm toward the second axis of the arm in the second state. The arm includes a contact surface that is provided to the second end of the arm and configured to contact the pressing member. The contact surface of the arm includes a point of action that receives a pressing force from the pressing member, the contact surface of the arm being parallel to the second axis of the arm and slanted relative to a virtual plane perpendicular to an axial line of the arm that extends from the point of action toward the second axis of the arm, when the swing body is in the second state.

Preferably, the contact surface of the arm may be slanted relative to the virtual plane such that, when the swing body is in the second state, the pressing force, which acts on the point of action in a direction perpendicular to the contact surface toward the second axis of the arm, is directed toward an area opposite the swing body via the axial line of the arm.

In some aspects of the present invention, when the swing body swings from the first state into the second state, the pressing force acts on the contact surface provided to the second end of the arm which contact surface is slanted relative to the virtual plane perpendicular to the axial line of the arm extending from the point of action toward the second axis of the arm. Therefore, a force component acting so as to put the swing body from the second state into the first state is applied to the arm. Thus, when the swing body is moved to be close to the main body, it is possible to prevent the swing body from colliding against the main body at a high speed.

According to aspects of the present invention, further provided is an image forming device, which includes a main body, a swing body attached to the main body swingably around a first axis as a predetermined swing central axis thereof between a first state where the swing body is away from the main body and a second state where the swing body is close to the main body, an arm having a first end and a second end in a longitudinal direction thereof, the first end of the arm being attached to a first one of the main body and the swing body, swingably around a second axis as a predetermined swing central axis of the arm, and a guide member provided to a second one of the main body and the swing body, the second end of the arm being joined with the guide member slidably in contact with the guide member from one end to a different end in the longitudinal direction of the guide member when the swing body swings from the first state to the second state. The guide member includes a sliding contact surface configured to establish slidable contact with the second end of the arm. The sliding contact surface includes first and second areas continuously formed in a longitudinal direction of the sliding contact surface, the second area being slanted relative to the first area.

Optionally, the second end of the arm may be adopted to slide in contact with the sliding contact surface of the guide member from the first area to the second area when the swing body swings from the first state to the second state. Preferably, in this case, the second area may be slanted relative to the first area such that an angle formed between the sliding contact surface and the arm when the second end of the arm is in contact with the second area of the sliding contact surface is greater than that formed when the second end of the arm is in contact with the first area of the sliding contact surface.

In some aspects of the present invention, an angle between the sliding contact surface and the arm to be formed when the second end of the arm is in contact with the second area of the sliding contact surface is greater than an angel therebetween to be formed when the second end of the arm is in contact with the first area of the sliding contact surface. Accordingly, a frictional force caused when the second end of the arm is in contact with the second area of the sliding contact surface is larger than that caused when the second end of the arm is in contact with the first area of the sliding contact surface. Thus, when the swing body is moved to be close to the main body, it is possible to prevent the swing body from colliding against the main body at a high speed.

According to aspects of the present invention, further provided is an image forming device, which includes a main body, a swing body attached to the main body swingably around a first axis as a predetermined swing central axis thereof between a first state in which the swing body is away from the main body and a second state in which the swing body is close to the main body, an arm having a first end and a second end in a longitudinal direction thereof, the first end of the arm being attached to a first one of the main body and the swing body, swingably around a second axis parallel to the first axis of the swing body as a predetermined swing central axis of the arm, a guide member provided to a second one of the main body and the swing body, the second end of the arm being joined with the guide member, slidably in contact with the guide member from one end to a different end in the longitudinal direction of the guide member when the swing body swings from the first state to the second state, the guide member including a sliding contact surface configured to establish slidable contact with the second end of the arm, the sliding contact surface including first and second areas continuously formed in a longitudinal direction of the sliding contact surface, the second area being slanted relative to the first area, and a pressing member provided to the second one of the main body and the swing body, the pressing member being configured to establish contact with the second end of the arm and press the arm toward the second axis of the arm in the second state. The arm includes a contact surface that is provided to the second end of the arm and configured to contact the pressing member. The contact surface of the arm includes a point of action that receives a pressing force from the pressing member, the contact surface of the arm being parallel to the second axis of the arm and slanted relative to a virtual plane perpendicular to an axial line of the arm that extends from the point of action toward the second axis of the arm.

According to the image forming device configured as above, in the same manners as described before, when the swing body is moved to be close to the main body, it is possible to prevent the swing body from colliding against the main body at a high speed.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Aspects of the present invention are applied to an electrophotographic image forming device. Hereinafter, embodiments according to aspects of the present invention will be described with reference to the accompanying drawings.

<Schematic Configuration of Image Forming Device>

Figure 1:
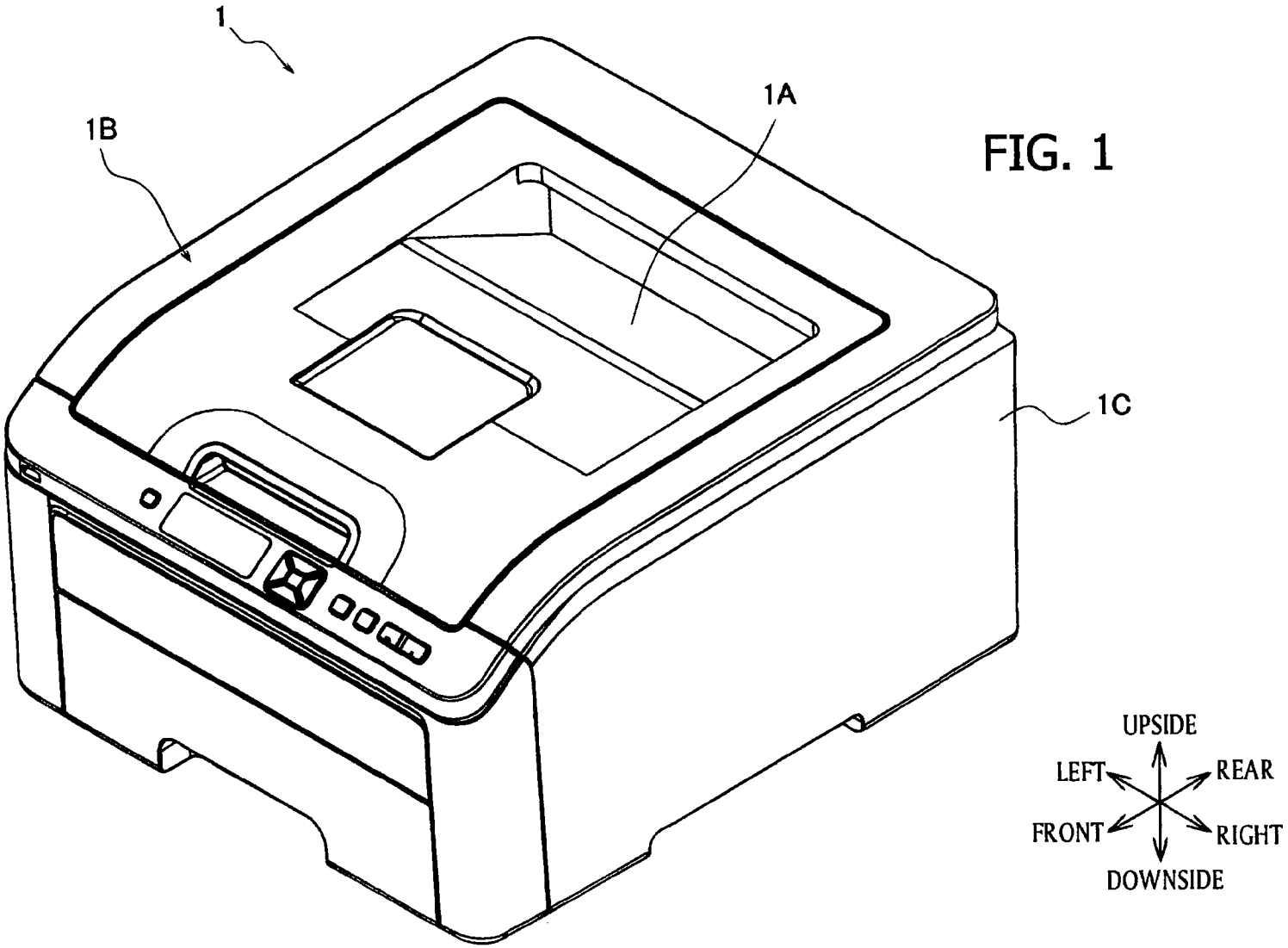
FIG. 1 is a perspective view schematically showing an external configuration of an image forming device in an embodiment according to one or more aspects of the present invention.
Figure 2:
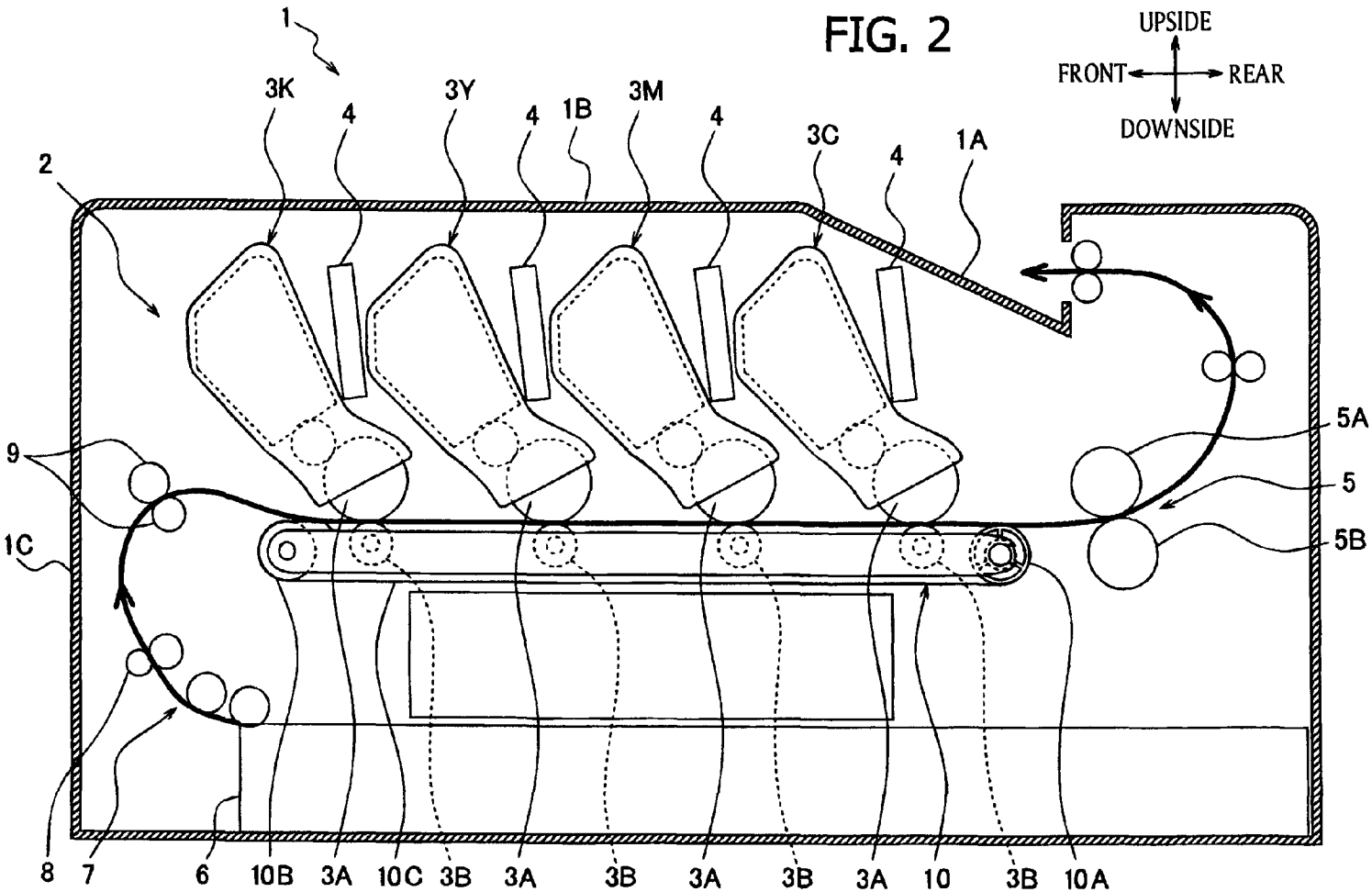
FIG. 2 is a cross-sectional view schematically showing an internal configuration of the image forming device in the embodiment according to one or more aspects of the present invention.

FIGS. 1 and 2 are a perspective view and a cross-sectional view schematically showing a configuration of an image forming device 1 in an embodiment. As illustrated in FIG. 2, the image forming device 1 includes an image forming unit 2 configured to form an image on a sheet or a transparent sheet for OHP (hereinafter, simply referred to as a sheet). The image forming unit 2 has four process cartridges 3K, 3Y, 3M, and 3C, four exposure units 4, and a fixing unit 5.

It is noted that a direct tandem method is applied to the image forming device 1 in the embodiment. Specifically, in the image forming device 1, four kinds of developer images, which are formed by the four process cartridges 3K, 3Y, 3M, and 3C of the image forming unit 2 that respectively correspond to developers of four colors Black, Yellow, Magenta, and Cyan, are superimposed on a sheet, and a color image is formed on the sheet.

Among a stack of sheets placed on a sheet feed tray 6, a top sheet picked up by a sheet feeding mechanism 7 is carried to a pair of registration rollers 9 after paper powder attached onto the sheet is removed by a paper powder removing roller 8. Skew correction is executed for the sheet by the registration rollers 9, and thereafter the sheet is conveyed to a belt unit 10.

The four process cartridges are linearly disposed on a side of a sheet carrying surface of the belt unit 10 in an order of the cartridges 3K, 3Y, 3M, and 3C from an upstream side in a sheet carrying direction. The four kinds of developer images are sequentially transferred onto the sheet being carried on the belt unit 10. Then, the developer images completely transferred are fixed onto the sheet through a heating treatment by the fixing unit 5.

The sheet on which the image formation has completely been achieved is discharged from the fixing unit 5, and the sheet carrying direction is directed upward. Thereafter, the sheet is discharged onto a catch tray 1A that is provided to a top cover 1B placed on an upper face side of the image forming device 1 (see FIG. 1).

In addition, as shown in FIG. 1, the top cover 1B configures an external design face of the image forming device 1 along with a housing 1C that constitutes a main body of the image forming device 1, and is swingably attached to an upper rear end side of the housing 1C.

Therefore, the top cover 1B is adopted to swing between an opened state and a closed state. Here, the opened state is a state in which the top cover 1B is kept away from the housing 1C such that an upper face side of the housing 1C is opened (see FIG. 3). Further, the closed state is a state in which the top cover 1B is kept close to the housing IC so as to close the upper face side of the housing 1C (see FIG. 2). It is noted that a swinging mechanism to allow the top cover 1B to swing (open and close) relative to the main body (the housing 1C) will be described in detail later.

In addition, as illustrated in FIG. 2, each of the process cartridge 3K, 3Y, 3M, and 3C has a photoconductive drum 3A and a charger (not shown) incorporated therein. Here, the photoconductive drum 3A is adopted to hold a developer image thereon, and the charger is adopted to charge the photoconductive drum 3A. When the photoconductive drum 3A charged is exposed to the exposure unit 4, an electrostatic latent image is formed on an outer circumferential surface of the photoconductive drum 3A. After that, when developer is supplied to the photoconductive drum 3A, a developer image is held (formed) on the outer circumferential surface of the photoconductive drum 3A.

Figure 12:
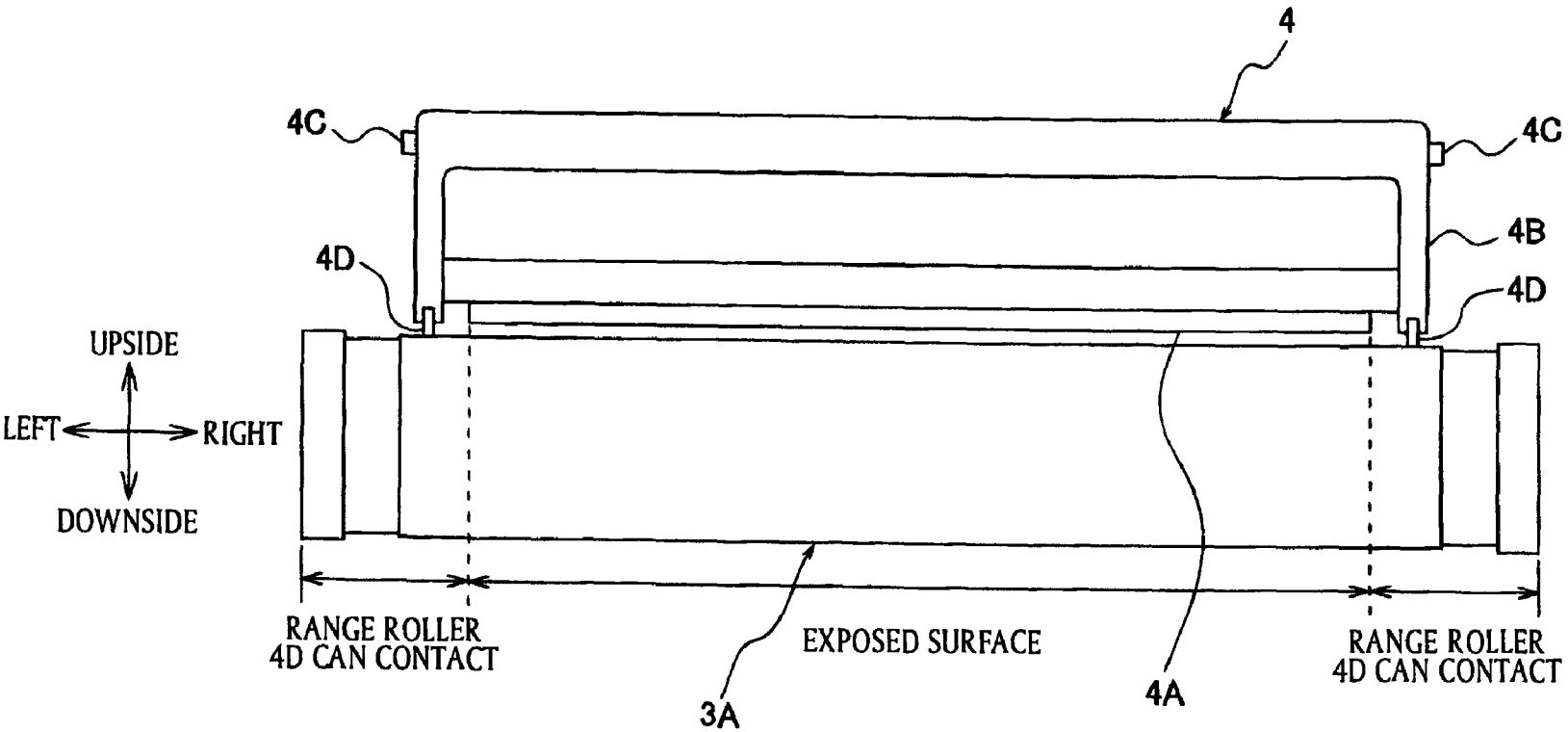
FIG. 12 is a schematic diagram showing relationship between an exposure unit and a photoconductive drum in the image forming device in the embodiment according to one or more aspects of the present invention.

Further, as illustrated in FIG. 12, the exposure unit 4 is configured with a light emitting portion 4A, which includes a plurality of LEDs configured to make light incident onto an exposed surface of the photoconductive drum 3A, and a holder 4B formed as a rectangular frame for supporting the light emitting portion 4A.

It is noted that the exposed surface of the photoconductive drum 3A represents an area, of the outer circumferential surface of the photoconductive drum 3A, on which a developer image is held. The LEDs included in the light emitting portion 4A are disposed in a position close to the exposed surface, linearly in an axial direction of the photoconductive drum 3A.

In addition, the holder 4B is swingably attached to the top cover 1B via shafts 4C provided on upper side faces of the holder 4B. Thereby, the holder 4B can swing relative to the top cover 1B mechanically in conjunction with the state of the top cover 1B between the opened state and the closed state.

Figure 3:
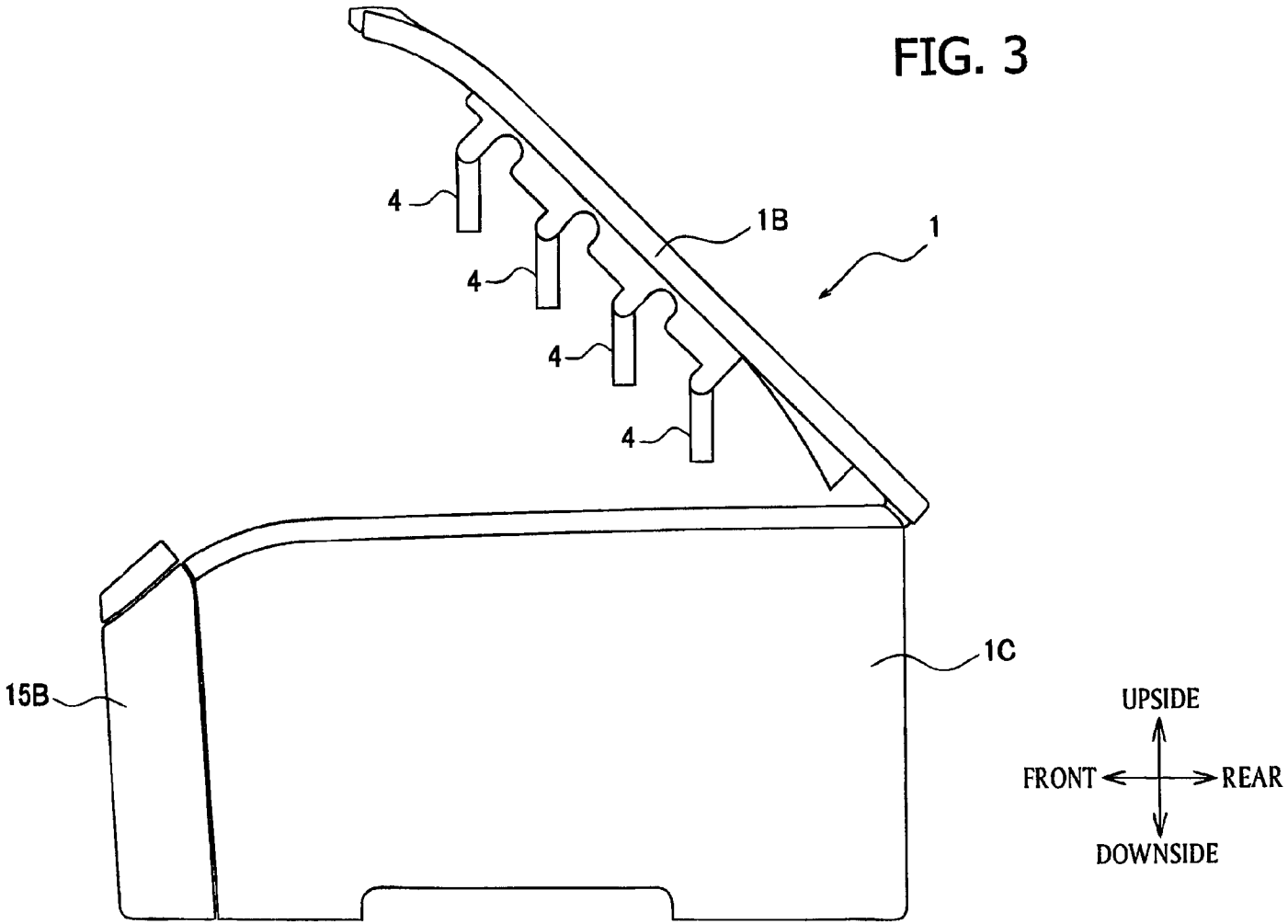
FIG. 3 is a schematic diagram showing an opened state in which a top cover of the image forming device is opened in the embodiment according to one or more aspects of the present invention.
Figure 4:
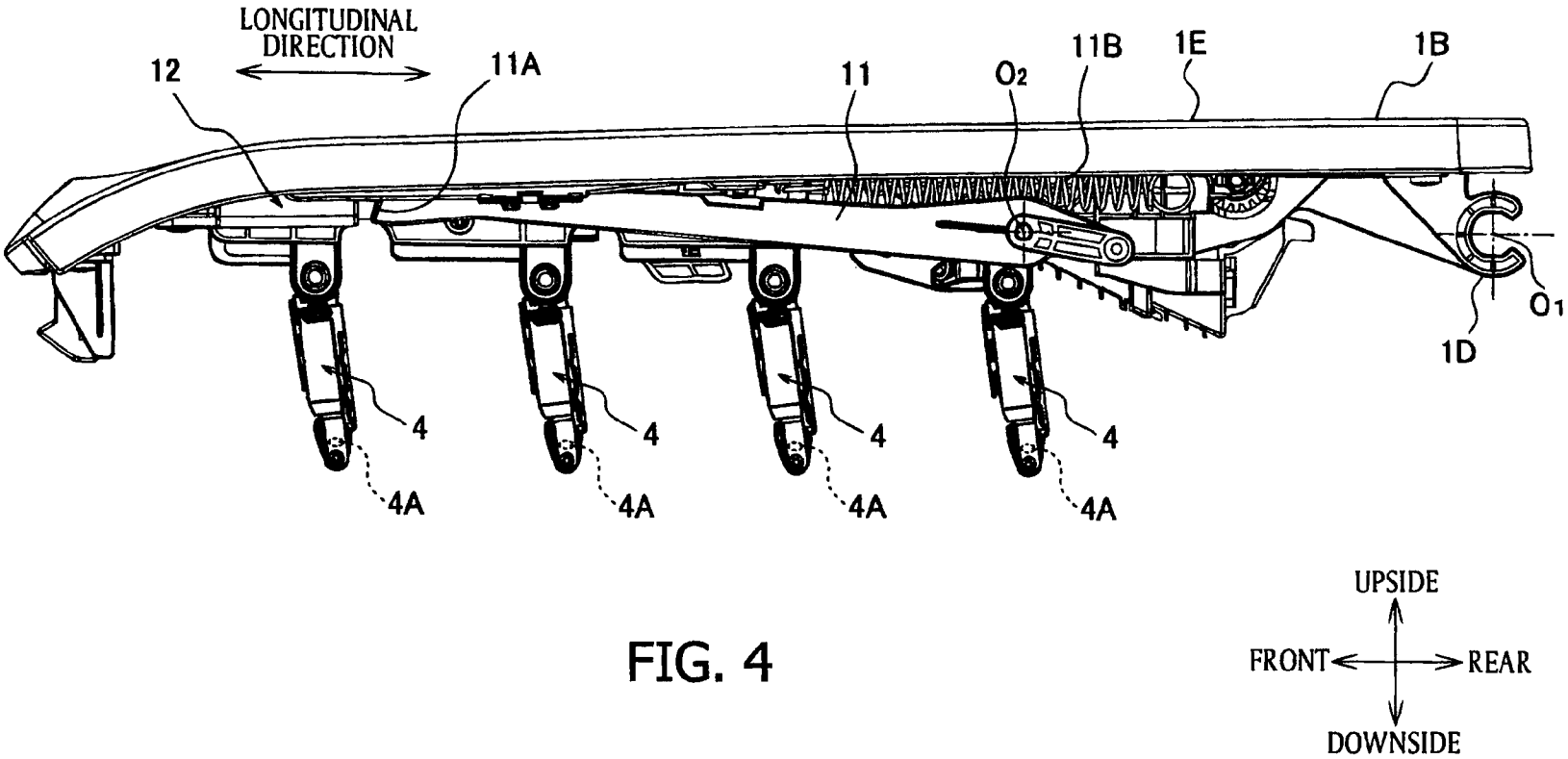
FIG. 4 is a side view of the top cover in the embodiment according to one or more aspects of the present invention.
Figure 5:
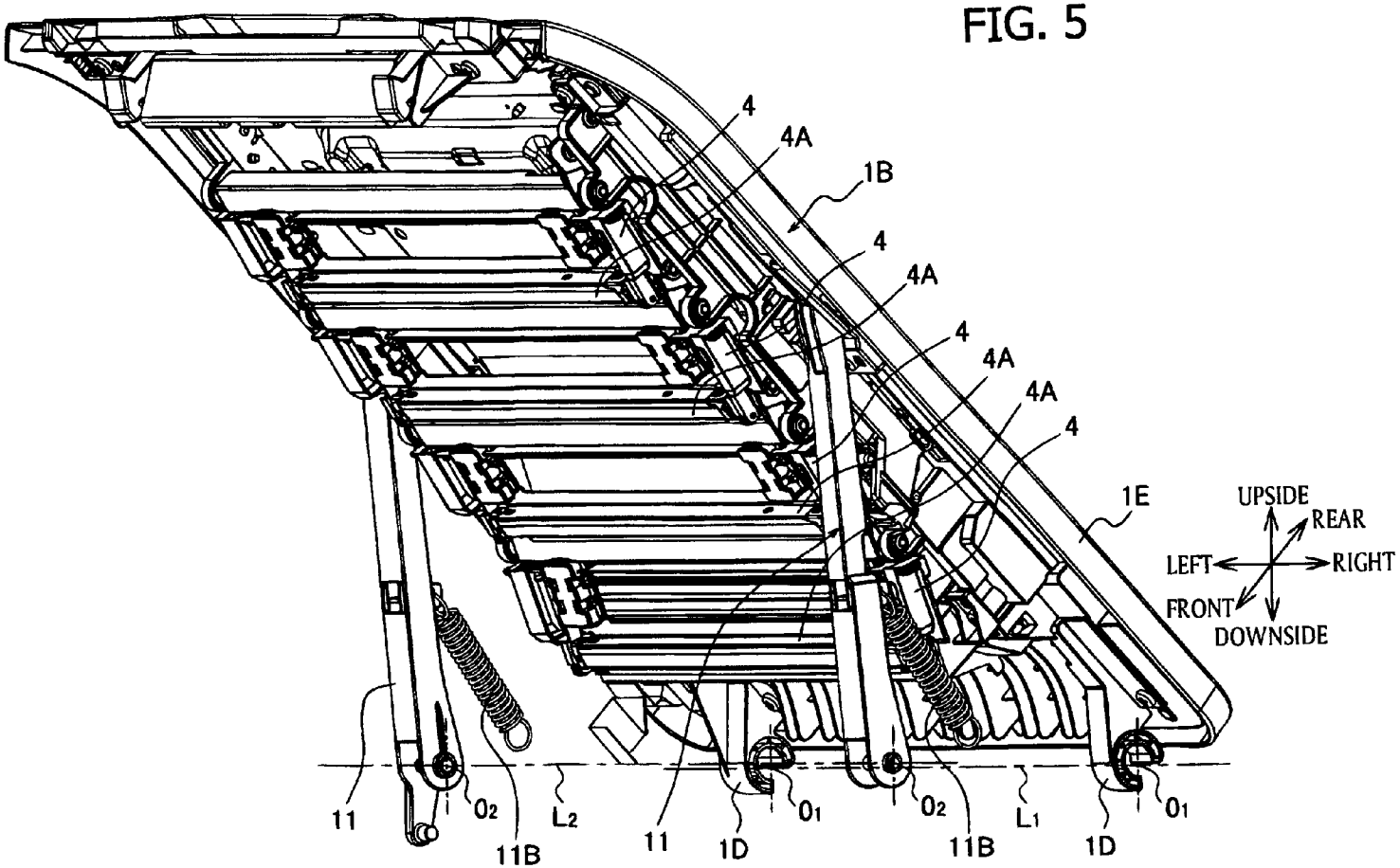
FIG. 5 is a perspective view showing a lower face side of the top cover in the opened state in the embodiment according to one or more aspects of the present invention.

Specifically, when the top cover 1B is closed and set into the closed state, as shown in FIG. 4, the light emitting portion 4A is located at a lower side and close to the exposed surface of the photoconductive drum 3A so as to form a greater angle between the holder 4B and the top cover 1B. Meanwhile, when the top cover 1B is opened and set into the opened state, as shown in FIG. 3 or 5, the light emitting portion 4A is close to the top cover 1B so as to form a smaller angle between the holder 4B and the top cover 1B.

In addition, as illustrated in FIG. 12, portions of the holder 4B which portions face the photoconductive drum 3A when the top cover 1B is in the closed state are provided with respective cylindrical rollers 4D. Each of the rollers 4D is configured to keep a predetermined distance between the light emitting portion 4A and the exposed surface by rotating in contact with the outer circumferential surface of the photoconductive drum 3A in a position away from the exposed surface toward an end side in the axial direction of the photoconductive drum 3A.

Therefore, in the closed state, the rollers 4D as portions of the exposure unit 4 establish contact with the photoconductive drum 3A, the top cover 1B receives from the photoconductive drum 3A a reaction force acting in such a direction that the top cover 1B is opened.

In addition, as shown in FIG. 2, the fixing unit 5 is configured with a heating roller 5A adopted to heat and fix developer onto a sheet, and a pressing roller 5B provided on a side opposite the heating roller 5A via the sheet fed and configured to press the sheet against the heating roller 5A.

<Swinging Mechanism of Top Cover>

As illustrated in FIG. 4, a substantially C-shaped hinge portion 1D is rotatably engaged with a hinge shaft (not shown) provided to the housing 1C (hereinafter referred to as a main body 1C). Thereby, the top cover 1B is swingably attached to the main body 1C. The hinge portion 1D is provided at a rear end on a lower face side of the top cover 1B, at each of both ends in a direction along a swing central line L1 (see FIG. 5) of the top cover 1B.

It is noted that, as illustrated in FIG. 5, the swing central line L1 is a virtual line passing through centers O1 of the two hinge portions 1D provided at the both ends of the top cover 1B in a left-to-right direction. The swing central line L1 extends along a width direction (left-to-right direction) of the top cover 1B.

Hereinafter, a direction that is perpendicular to the swing central line L1 and parallel to an external design face 1E (see FIG. 4) of the top cover 1B will be referred to as a longitudinal direction (see FIG. 4) of the top cover 1B. Additionally, an end opposite the hinge portion 1D in the longitudinal direction of the top cover 1B will be referred to as a front end (left side in FIG. 4) in the longitudinal direction of the top cover 1B. Further, a direction parallel to the swing central line L1 will be referred to as a width direction of the top cover 1B.

As shown in FIG. 5, at both ends in the width direction of the top cover 1B, swing arms 11 are provided, each of which has one end in a longitudinal direction attached swingably to the main body 1C and the other end attached slidably to the top cover 1B.

Specifically, a swing central line L2 of the swing arms 11 and the swing central line L1 of the top cover 1B are parallel to one another. Further, each of the swing arms 11 has the other end in the longitudinal direction thereof (hereinafter referred to as a slide end 11A (see FIG. 7)), which end is adopted to be translated in the longitudinal direction of the top cover 1B so as to get close to or away from the swing center O1.

Figure 6:
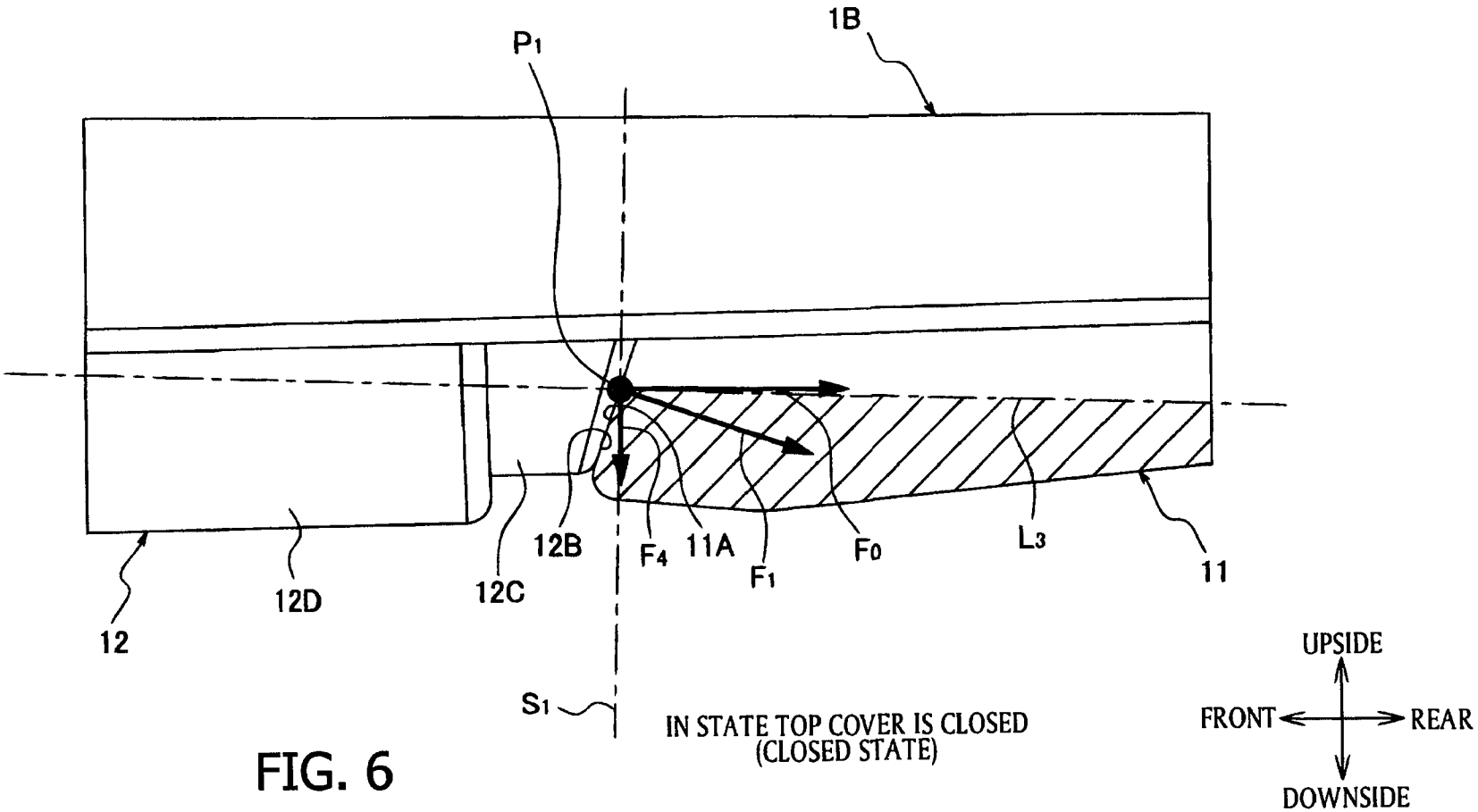
FIGS. 6 to 11 show operations of a swing arm and the top cover in various states in the embodiment according to one or more aspects of the present invention.
Figure 7:
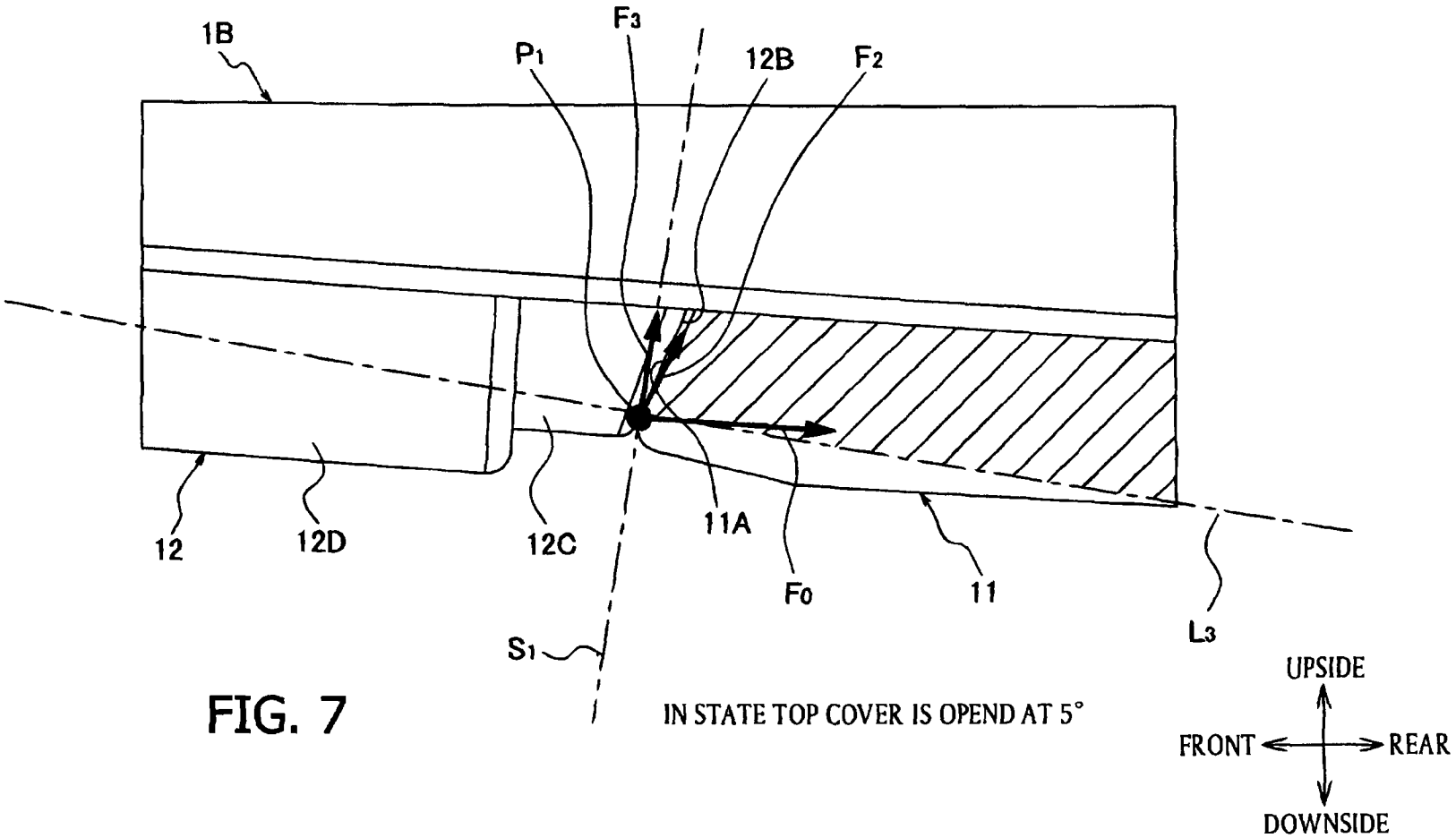
Figure 8:
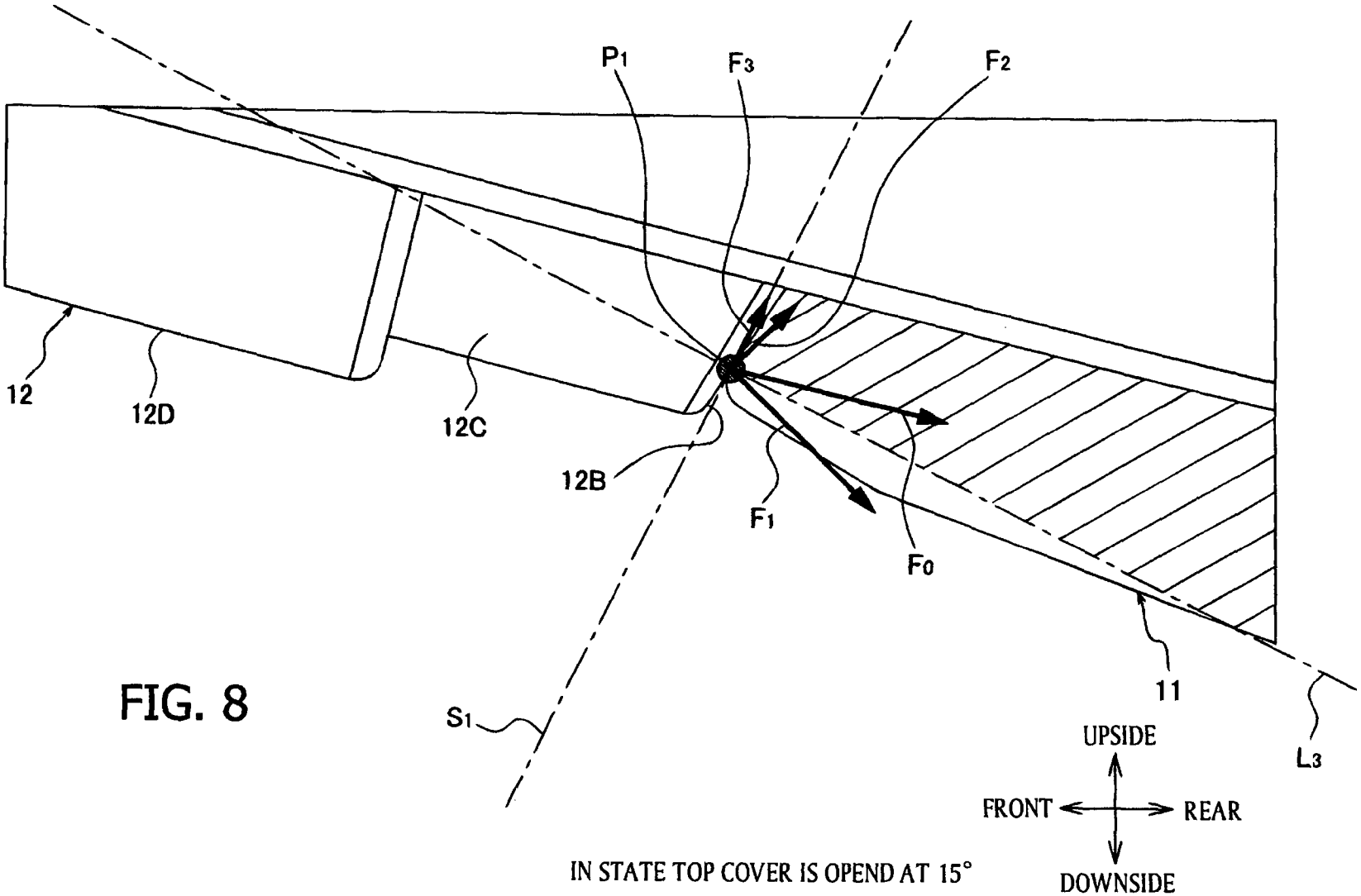
Figure 9:
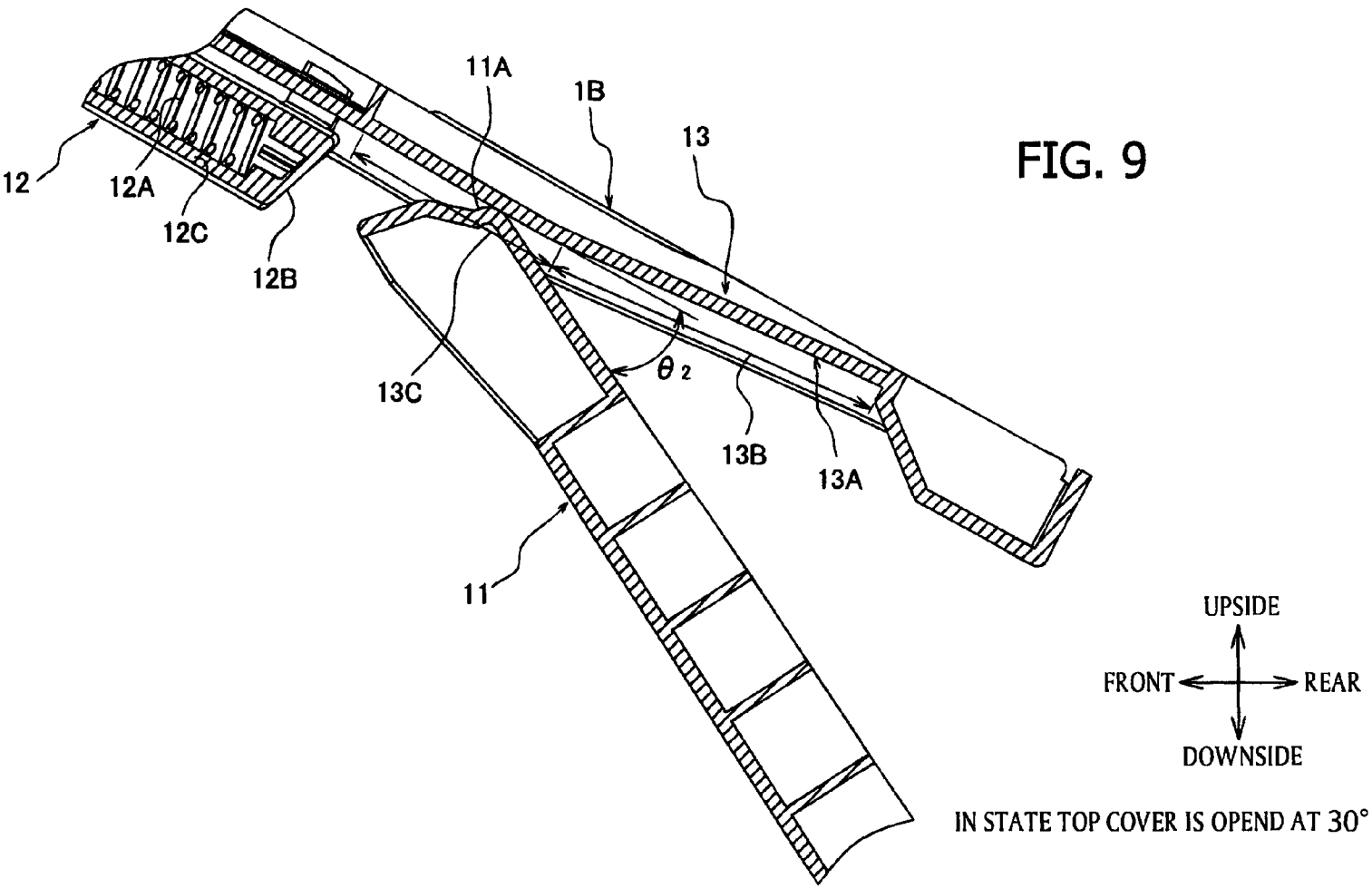
Figure 10:
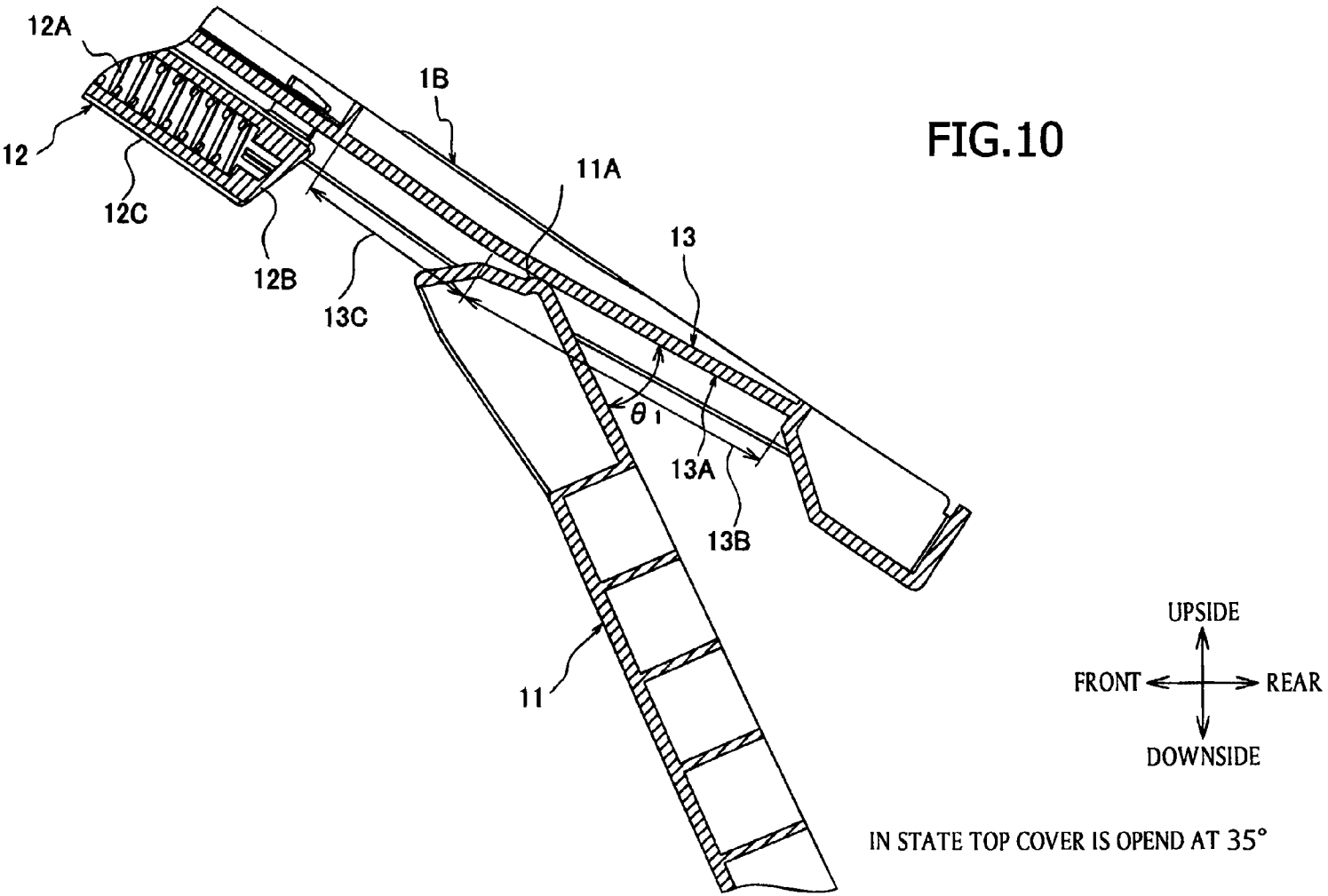
Figure 11:
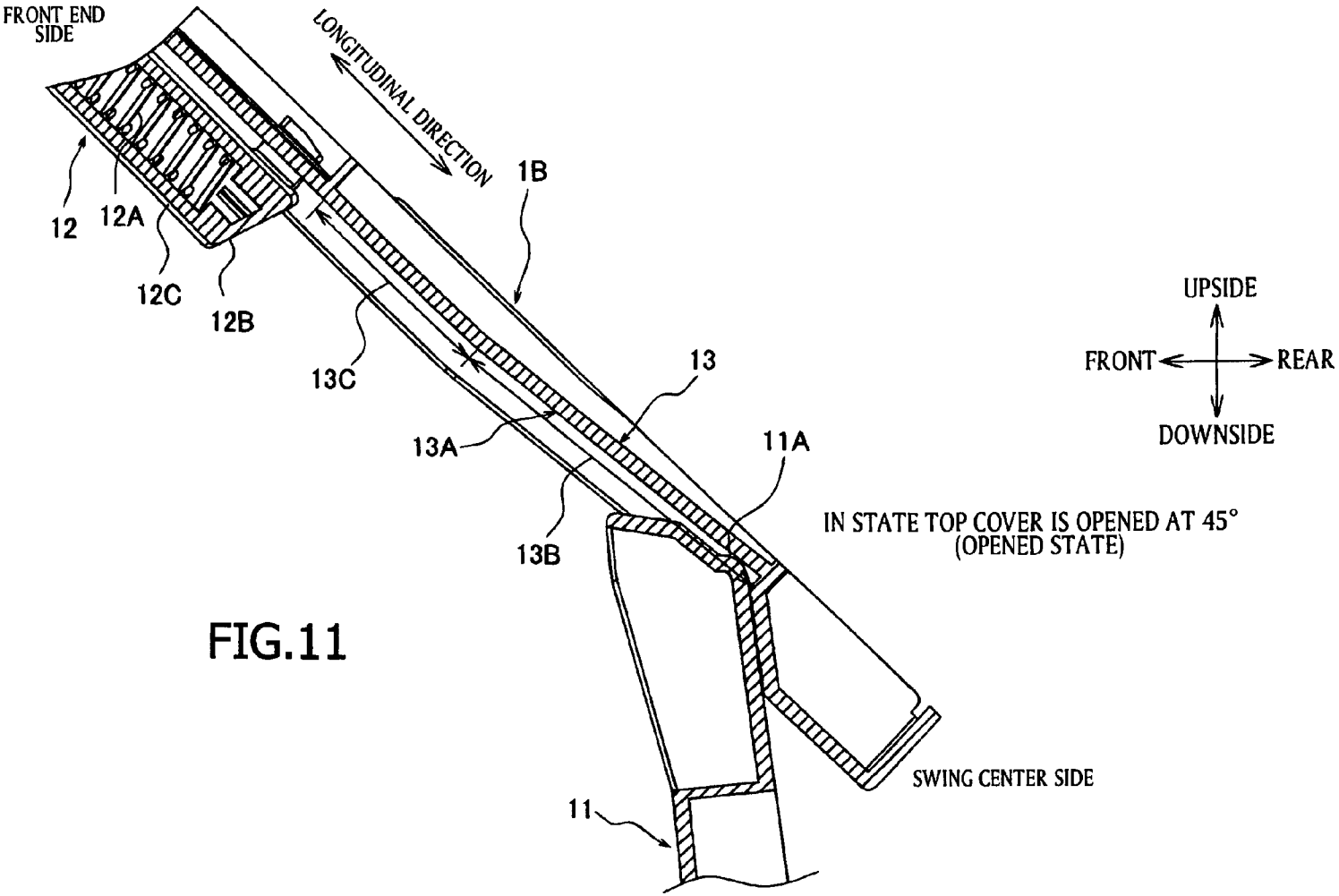

Therefore, the slide end 11A of the swing arm 11 moves from the opened state to the closed state in an order of FIG. 11→FIG. 10→FIG. 9→FIG. 8→FIG. 7 while sliding in contact with a guide member 13 (see FIG. 11) provided to the top cover 1B from one end to the other end in a longitudinal direction of the guide member 13. Finally, as illustrated in FIG. 6, the slide end 1A gets in contact with a below-mentioned damper 12 and set in the closed state.

Incidentally, the other end in the longitudinal direction of the swing arm 11 is guided while protrusions (not shown) provided at both ends in a width direction of the other end are sliding in engagement with a groove of a guide rail (not shown) provided to the top cover 1B.

As illustrated in FIG. 4 or 5, the swing arm 11 is adopted such that the swing center O2 thereof is located away from the swing center O1 of the top cover 1B toward the front end in the longitudinal direction of the top cover 1B. Further, the swing arm 11 is adopted such that the swing center O2 thereof is close to the swing center O1 of the top cover 1B relative to the slide end 11A of the swing arm 11 when the top cover 1B is in the closed state as shown in FIG. 4.

Further, as illustrated in FIG. 5, an intermediate portion in the longitudinal direction of the swing arm 11 is joined with an end of a coil spring 11B configured to provide an elastic force for pulling the swing arm 11 toward the swing center O1 of the top cover 1B. The other end of the spring 11B is joined with the main body 1C.

In addition, as shown in FIG. 4, a damper 12 is provided at each of the both ends in the width direction of the top cover 1B at the front end in the longitudinal direction of the top cover 1B. The damper 12 is configured to contact the slide end 11A of the swing arm 11 when the top cover 1B is in the closed state and to press the swing arm 11 toward the swing center O2.

As shown in FIG. 9, the damper 12 includes a spring 12A, a cap 12*c*, and a casing 12D (see FIG. 6). The spring 12A is an elastic coil having an axial direction parallel to the longitudinal direction of the top cover 1B.

The cap 12C is shaped to be substantially cylindrical and configured to form a contact surface 12B to be in contact with the slide end 11A so as to cover a slide end 11A side of the spring 12A. The cap 12*c* is made of resin identical to that for the swing arm 11 (the slide end 11A).

In addition, the casing 12D is adopted to house the cap 12C and the spring 12A. Further, the casing 12D is configured such that the cap 12C is inserted therein so as to allow the cap 12C to move in a direction parallel to the longitudinal direction of the top cover 1B. The casing 12D is integrated with the top cover 1B.

Therefore, regardless of whether the top cover 1B is in the opened state or the closed state, the damper 12 can generate a pressing force acting in a direction parallel to the longitudinal direction of the top cover 1B from the front end of the top cover 1B to the swing center O1 of the top cover 1B.

As illustrated in FIG. 6, a contact surface of the swing arm 11 that is configured to establish contact with the damper 12, namely, the slide end 11A is adopted to, when the top cover 1B is in the closed state, be parallel to the swing central line L2 of the swing arm 11 and slanted relative to a virtual plane S1 perpendicular to an arm axial line L3.

Here, the arm axial line L3 is a virtual line connecting the swing center O2 of the swing arm 11 with a point of action P1 of the slide end 11A on which a force Fo (hereinafter referred to as a pressing force Fo) from the damper 12 acts.

Further, the point of action P1 represents a contact point between the swing arm 11 and the damper 12. When the swing arm 11 and the damper 12 establish surface contact at a contact surface therebetween, a point of the contact surface on which the greatest force acts in the closed state is defined as the point of action P1.

The slide end 11A is slanted relative to the virtual plane S1 such that a vertical force component F1 acting on the slide end 11A due to the pressing force Fo is directed toward an area (a shaded area in FIG. 6) opposite the top cover 1B via the arm axial line L3 when the top cover 1B is in the closed state.

It is noted that the vertical force component F1 represents a force, acting on the slide end 11A due to the pressing force Fo, which goes through the point of action P1 in a direction perpendicular to the slide end 11A toward the swing center O2 of the swing arm 11.

In addition, as illustrated in FIG. 6, the contact surface 12B of the damper 12 which surface establishes contact with the slide end 11A and makes the pressing force Fo act on the swing arm 11 is configured to be parallel to the slide end 11A when the top cover 1B is in the closed state.

Further, as shown in FIG. 11, a sliding contact surface 13A of the guide member 13 which surface establishes slidable contact with the slide end 11A extends in a direction substantially parallel to the longitudinal direction of the top cover 1B. Moreover, an area 13B (hereinafter referred to as a slanted area 13B) at a swing center O1 side of the sliding contact surface 13A is slanted relative to an area 13C (hereinafter referred to as a straight area 13C) at a front end side of the sliding contact surface 13A.

Namely, the sliding contact surface 13A in the straight area 13C is parallel to the longitudinal direction of the top cover 1B. Meanwhile, the sliding contact surface 13A in the slanted area 13B is slanted relative to the straight area 13C so as to be closer to the surface (the surface with the catch tray 1A formed thereon) of the top cover 1B toward the swing center O1 of the top cover 1B.

<Features of Image Forming Device>

In the embodiment, the slide end 11A of the swing arm 11 that establishes contact with the damper 12 is parallel to the swing central line L2 of the swing arm 11 and slanted relative to the virtual plane S1 perpendicular to the arm axial line L3 when the top cover 1B is in the closed state.

Therefore, when the top cover 1B is shifted from the opened state to the closed state, as shown in FIG. 8→FIG. 7, the pressing force Fo acts toward an area (shaded areas in FIGS. 7 and 8) at a side of the top cover 1B via the arm axial line L3.

Accordingly, in the transition process of the top cover 1B from the opened state to the closed state, as shown in FIGS. 7 and 8, a force F3 (a spacing force F3) in such a direction as to shift the top cover 1B from the closed state to the opened state acts on the slide end 11A of the swing arm 11. It is noted that the spacing force F3 represents a force component parallel to the virtual plane S1 of a force component F2 parallel to the slide end 11A of the pressing force Fo.

Thus, in the embodiment, when an open angle of the top cover 1B (an open angle after the contact between the swing arm 11 and the damper 12) is equal to or less than 25 degrees (see FIGS. 7 and 8), the damper 12 applies the spacing force F3 onto the swing arm 11. Therefore, when being shut to be close to the main body IC, the top cover 1B can be prevented from colliding against the main body 1C at a high speed.

Then, when the top cover 1B completely comes into the closed state, as illustrated in FIG. 6, the vertical force component F1 is directed toward an area opposite the top cover 1B via the arm axial line. Thereby, a force component F4 (an approximating force F4) acts on the top cover 1B so as to move the top cover 1B in the closed state to be closer to the main body IC. It is noted that the approximating force F4 is a force component parallel to the virtual plane S1 of the vertical force component F1.

Accordingly, in the embodiment, when being shut to be close to the main body 1C, the top cover 1C can be prevented from colliding against the main body at a high speed. Further, when the top cover 1B completely comes into the closed state, the closed state can stably be maintained, and the top cover 1B can be prevented from being unnecessarily moved.

It is noted that "the top cover 1B completely comes into the closed state" denotes that the top cover 1B can no longer move to be closer to the main body 1C. Further, in the embodiment, the swing center O2 of the swing arm 11 is located away from the swing center O1 of the top cover 1B. Further, when the top cover 1B is in the closed state, the swing center O2 of the swing arm 11 is closer to the swing center O1 of the top cover 1B than the slide end 11A. Hence, when the top cover 1B is moved from the opened state to the closed state, the slide end 11A slides and comes to be more away from the swing center O1 of the top cover 1B, as shown in an order of FIG. 11 FIG. 10 FIG. 9→FIG. 8→FIG. 7→FIG. 6.

Therefore, a distance between a point on which the spacing force F3 acts and the swing center O1 of the top cover 1B is larger along with the movement of the top cover 1B from the opened state to the closed state. Thus, when being shut to be close to the main body 1C, the top cover 1B can effectively be prevented from colliding against the main body 1C at a high speed.

Further, according to the embodiment, in the closed state, as illustrated in FIG. 6, the slide end 11A and the damper 12 establish surface contact. Hence, the approximating force F4 can stably be applied onto the swing arm 11, and thereby the top cover 1B can certainly be prevented from being unnecessarily moved.

Further, in the embodiment, as described before, the top cover 1B receives a force that makes the top cover 1B come into the opened state via the exposure unit 4. Meanwhile, when the top cover 1B is completely in the closed state, the closed state is maintained. Thus, it is possible to prevent the top cover 1B from being unnecessarily moved.

Further, in the embodiment, the slanted area 13B of the sliding contact surface 13A is slanted relative to the straight area 13C. Therefore, than an angle θ1 (see FIG. 10) between the sliding contact surface 13A and the swing arm 11 in the case where the slide end 1A contacts the slanted area 13B, an angle θ2 (see FIG. 9) therebetween in the case where the slide end 11A contacts the straight area 13C is greater.

Accordingly, a larger frictional force is caused between the sliding contact surface 13A and the slide end 11A when the slide end 11A contacts the straight area 13C than when the slide end 11A contacts the slanted area 13B. Therefore, when being shut to be close to the main body 1C, the top cover 1B can be prevented from colliding against the main body 1C at a high speed.

Namely, according to the embodiment, before the slide end 11A comes into contact with the damper 12, the guide member 13 keeps the top cover 1B from being shut at a high speed. Meanwhile, after the slide end 11A comes into contact with the damper 12, the damper 12 keeps the top cover 1B from being shut at a high speed.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein. For example, the present invention is capable of the following modifications.

<Modifications>

In the aforementioned embodiment, the swing center O2 of the swing arm 11 is in a position off the swing center O1 of the top cover 1B. Further, when the top cover 1B is in the closed state, the swing center O2 of the swing arm 11 is closer to the swing center O1 of the top cover 1B than the slide end 11A. However, for example, the swing center O2 of the swing arm 11, which is in a position off the swing center O1 of the top cover 1B, may be closer to the front end side of the top cover 1B than the slide end 11A when the top cover 1B is in the closed state.

Further, in the aforementioned embodiment, the swing arm 11 is attached swingably to the main body 1C. However, the swing arm 11 may be attached swingably to the top cover 1B.

Further, in the aforementioned embodiment, aspects of the present invention are applied to an image forming device capable of color printing. However, for instance, aspects of the present invention may be applied to an image forming device adopted just for monochrome printing.

Further, in the aforementioned embodiment, LEDs are employed for the exposure unit. However, the exposure unit may be configured to scan laser light. Further, in the aforementioned embodiment, a direct tandem method is employed to form a color image on a sheet by superimposing on the sheet four kinds of developer images formed by the four process cartridges 3K, 3Y, 3M, and 3C as the image forming unit 2 that correspond to four colors of developers, respectively. However, aspects of the present invention may be applied to an image forming device using an intermediate transfer method, an image forming device adopted just for monochrome printing, or an image forming device provided with two or three process cartridges.

What is claimed is:

1. An image forming device, comprising:

a main body;

a swing body attached to the main body swingably around a first axis as a predetermined swing central axis thereof between a first state where the swing body is away from the main body and a second state where the swing body is close to the main body;

an arm having a first end and a second end in a longitudinal direction thereof, the first end of the arm being attached to a first one of the main body and the swing body, swingably around a second axis parallel to the first axis of the swing body as a predetermined swing central axis of the arm, the second end of the arm being joined with a second one of the main body and the swing body, slidably to be close to or away from the first axis of the swing body; and a pressing member provided to the second one of the main body and the swing body, the pressing member being configured to establish contact with the second end of the arm and to press the arm toward the second axis of the arm in the second state, wherein the arm includes a contact surface that is provided to the second end of the arm and configured to contact the pressing member, the contact surface of the arm including a point of action that receives a pressing force from the pressing member, the contact surface of the arm being parallel to the second axis of the arm and slanted relative to a virtual plane perpendicular to an axial line of the arm that extends from the point of action toward the second axis of the arm, when the swing body is in the second state.

2. The image forming device according to claim 1, wherein the contact surface of the arm is slanted relative to the virtual plane such that, when the swing body is in the second state, the pressing force, which acts on the point of action in a direction perpendicular to the contact surface toward the second axis of the arm, is directed toward an area opposite the swing body via the axial line of the arm.

3. The image forming device according to claim 2, wherein the first end of the arm is attached to the main body swingably around the second axis fixed to the main body, wherein the second axis of the arm is in a position off the first axis of the swing body, and wherein, when the swing body is in the second state, the second axis of the arm is closer to the first axis of the swing body than the second end of the arm.

4. The image forming device according to claim 3, wherein the pressing member is configured to generates the pressing force in a direction from a swing end of the swing body toward the first axis of the swing body.

5. The image forming device according to claim 4, wherein the pressing member has a contact portion configured to contact the contact surface of the arm and apply the pressing force onto the contact surface, the contact portion including a plane parallel to the contact surface of the arm when the swing body is in the second state.

6. The image forming device according to claim 5, further comprising:

a photoconductive body configured to hold thereon a developer image to be transferred onto a sheet; and an exposure unit attached to a side of the swing body that faces the main body, the exposure unit being configured to expose the photoconductive body, the exposure unit being configured to contact the photoconductive body and receive a reaction force from the photoconductive body when the swing body is in the second state.

7. The image forming device according to claim 1, further comprising:

a photoconductive body configured to hold thereon a developer image to be transferred onto a sheet; and an exposure unit attached to a side of the swing body that faces the main body, the exposure unit being configured to expose the photoconductive body, the exposure unit being configured to contact the photoconductive body and receive a reaction force from the photoconductive body when the swing body is in the second state.

8. An image forming device, comprising:

a main body;

a swing body attached to the main body swingably around a first axis as a predetermined swing central axis thereof between a first state where the swing body is away from the main body and a second state where the swing body is close to the main body;

an arm having a first end and a second end in a longitudinal direction thereof, the first end of the arm being attached to a first one of the main body and the swing body, swingably around a second axis as a predetermined swing central axis of the arm; and a guide member provided to a second one of the main body and the swing body, the second end of the arm being joined with the guide member slidably in contact with the guide member from one end to a different end in the longitudinal direction of the guide member when the swing body swings from the first state to the second state, wherein the guide member includes a sliding contact surface configured to establish slidable contact with the second end of the arm, the sliding contact surface including first and second areas continuously formed in a longitudinal direction of the sliding contact surface, the second area being slanted relative to the first area.

9. The image forming device according to claim 8, wherein the second end of the arm is adopted to slide in contact with the sliding contact surface of the guide member from the first area to the second area when the swing body swings from the first state to the second state, and wherein the second area is slanted relative to the first area such that an angle formed between the sliding contact surface and the arm when the second end of the arm is in contact with the second area of the sliding contact surface is greater than that formed when the second end of the arm is in contact with the first area of the sliding contact surface.

10. The image forming device according to claim 8, wherein the first end of the arm is attached to the main body swingably around the second axis fixed to the main body, wherein the second axis of the arm is in a position off the first axis of the swing body, and wherein, when the swing body is in the second state, the second axis of the arm is closer to the first axis of the swing body than the second end of the arm.

11. The image forming device according to claim 8, further comprising an elastic member configured to apply, to the arm, an elastic force for putting the swing body into the first state.

12. An image forming device, comprising:

a main body;

a swing body attached to the main body swingably around a first axis as a predetermined swing central axis thereof between a first state in which the swing body is away from the main body and a second state in which the swing body is close to the main body;

an arm having a first end and a second end in a longitudinal direction thereof, the first end of the arm being attached to a first one of the main body and the swing body, swingably around a second axis parallel to the first axis of the swing body as a predetermined swing central axis of the arm;

a guide member provided to a second one of the main body and the swing body, the second end of the arm being joined with the guide member, slidably in contact with the guide member from one end to a different end in the longitudinal direction of the guide member when the swing body swings from the first state to the second state, the guide member including a sliding contact surface configured to establish slidable contact with the second end of the arm, the sliding contact surface including first and second areas continuously formed in a longitudinal direction of the sliding contact surface, the second area being slanted relative to the first area; and a pressing member provided to the second one of the main body and the swing body, the pressing member being configured to establish contact with the second end of the arm and press the arm toward the second axis of the arm in the second state, wherein the arm includes a contact surface that is provided to the second end of the arm and configured to contact the pressing member, the contact surface of the arm including a point of action that receives a pressing force from the pressing member, the contact surface of the arm being parallel to the second axis of the arm and slanted relative to a virtual plane perpendicular to an axial line of the arm that extends from the point of action toward the second axis of the arm.

* * * * *